US011325763B2

(12) United States Patent
Tsang et al.

(10) Patent No.: US 11,325,763 B2
(45) **Date of Patent: *May 10, 2022**

(54) CONTAINER SECURITY SYSTEM

(71) Applicant: In-Tech Enterprise Ltd., Kowloon (HK)

(72) Inventors: Jacky Sai Ping Tsang, Shatin (HK); Cheuk Kuen Chim, Shatin (HK); Gordon Christopher Pope, The Peak (HK); Wing Hung Cheung, Kowloon (HK)

(73) Assignee: In-Tech Enterprise Ltd., Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/229,281

(22) Filed: Apr. 13, 2021

(65) Prior Publication Data

US 2021/0300647 A1 Sep. 30, 2021

Related U.S. Application Data

(63) Continuation of application No. 16/746,562, filed on Jan. 17, 2020, now Pat. No. 10,974,882, which is a (Continued)

(51) Int. Cl.
*B65D 55/02* (2006.01)
*B65D 51/18* (2006.01)
(Continued)

(52) U.S. Cl.
CPC ..... *B65D 55/028* (2013.01); *B65D 51/18* (2013.01); *G08B 13/02* (2013.01); *G08B 13/14* (2013.01); *B65D 55/02* (2013.01); *B65D 2401/00* (2020.05)

(58) Field of Classification Search
CPC ..... B65D 55/028; B65D 51/18; B65D 55/02; B65D 2401/00; G08B 13/02; G08B 13/14
See application file for complete search history.

(56) References Cited

U.S. PATENT DOCUMENTS 7,302,609 B2 11/2007 Matena
7,649,455 B2 1/2010 Easley
(Continued)

FOREIGN PATENT DOCUMENTS

CN 104685549 A 6/2015
CN 108462968 A 8/2018
(Continued)

OTHER PUBLICATIONS

Notice of First Office Action, Chinese Application No. 201910241415.0, dated May 7, 2020, 11 pages.
(Continued)

*Primary Examiner* — John A Tweel, Jr.
(74) *Attorney, Agent, or Firm* — Haynes and Boone, LLP

(57) ABSTRACT

A container security system includes a container chassis and a closure subsystem coupled to the container chassis. The closure subsystem includes a closure chassis that prevents movement of a material between a container volume and an exterior of the container chassis via an aperture defined by the container chassis. The closure subsystem includes a closure security sensor that generates a closure sensor signal when the closure chassis experiences a tamper event. A first type communication interface is housed in the closure chassis and a security engine provided by the closure subsystem receives a sensor signal indicating that the closure chassis has experienced the tamper event. The security engine then provides, in response to receiving the sensor signal and using the first type communication interface, a notification to a corresponding first type communication
(Continued)

interface that the closure chassis has experienced the tamper event.

20 Claims, 8 Drawing Sheets

Related U.S. Application Data continuation of application No. 15/938,552, filed on Mar. 28, 2018, now Pat. No. 10,538,371.

(51) Int. Cl.
*G08B 13/02* (2006.01)
*G08B 13/14* (2006.01)

(56) References Cited

U.S. PATENT DOCUMENTS

| | | | |
|---|---|---|---|
| 8,040,244 | B2 | 10/2011 | Bauchot |
| 8,280,345 | B2 | 10/2012 | Twitchell, Jr. |
| 8,456,302 | B2 | 6/2013 | Stevens |
| 9,798,294 | B2 | 10/2017 | Markel et al. |
| 10,358,259 | B2 | 7/2019 | Andersen |
| 10,538,371 | B2 | 1/2020 | Tsang et al. |
| 10,654,619 | B2 * | 5/2020 | Teper ..... B65D 23/108 |
| 10,769,934 | B2 | 9/2020 | Tsang |
| 10,974,882 | B2 * | 4/2021 | Tsang ..... G08B 13/02 |
| 2005/0005200 | A1 | 1/2005 | Matena et al. |
| 2006/0095778 | A1 | 5/2006 | He et al. |
| 2006/0290491 | A1 | 12/2006 | Wagner et al. |
| 2007/0115859 | A1 | 5/2007 | Meyers |
| 2009/0124304 | A1 | 5/2009 | Twitchell, Jr. |
| 2010/0117797 | A1 | 5/2010 | Bauchot et al. |
| 2014/0091931 | A1 | 4/2014 | Cova et al. |

FOREIGN PATENT DOCUMENTS

| | | | |
|---|---|---|---|
| EP | 2083412 | A1 | 7/2009 |
| EP | 3284692 | A1 | 2/2018 |
| WO | 2008088341 | A1 | 7/2008 |

OTHER PUBLICATIONS

Extended European Search Report, dated Aug. 9, 2019, European Application No. 19165829.3, 10 pages.
Extended European Search Report, dated Sep. 16, 2020, European Application No. 20182232.7, 7 pages.
Office Action, dated May 24, 2021, Chinese Application No. 202010581350.7, 11 pages.

* cited by examiner

CONTAINER SECURITY SYSTEM

CROSS-REFERENCE TO RELATED APPLICATIONS

This application is a continuation application of U.S. patent application Ser. No. 16/746,562, filed Jan. 17, 2020, entitled "CONTAINER SECURITY SYSTEM", issuing Apr. 13, 2021, as U.S. Pat. No. 10,974,882, which is a continuation application of U.S. patent application Ser. No. 15/938,552, filed Mar. 28, 2018, entitled "CONTAINER SECURITY SYSTEM", now U.S. Pat. No. 10,538,371, is related to U.S. patent application Ser. No. 16/451,879, filed Jun. 25, 2019, entitled "CONTAINER SECURITY SYSTEM", now U.S. Pat. No. 10,769,934, and is related to U.S. patent application Ser. No. 17/011,574, filed Sep. 3, 2020, entitled "CONTAINER SECURITY SYSTEM", the disclosures of which are incorporated herein by reference in their entirety.

FIELD OF THE DISCLOSURE

This disclosure relates generally to containers, and, more particularly, to closure security systems for containers.

BACKGROUND

Containers may be used for storage, shipping, and packaging of a variety of products. For example, intermediate bulk containers (IBC), drums, barrels, bottles, and/or other containers are designed for the transport and storage of bulk liquid and granulated substances such as chemicals, food ingredients, solvents, pharmaceuticals, hazardous materials, and/or a variety of other goods and products known in the art. Containers typically have one or more openings that allow access to the containers through which the container may be filled with the product, and/or through which the product may be dispensed from the container. During shipment and storage, these openings may be obstructed with a variety of closures such as, for example, caps, plugs, tops, valves, lids, and other closures. These closures provide many benefits for the container and the product being shipped and/or stored within the container such as, for example, preventing the product within the container from escaping, preventing materials from outside of the container from entering the container and contaminating the product, preventing spoilage, as well as other uses that would be apparent to one of skill in the art.

Conventional closures attempt to provide container security by including seals that, when broken, indicate whether the container has been opened, prior to, or subsequent to filling the container with the product. Due to the nature of some products being shipped in containers, seals may be important for tracking and determining whether the product within the container has been tampered with (e.g., lost, stolen, and/or contaminated). For example, high value liquids used in agrochemical industries may be stolen and/or replaced with counterfeit products, and products used in food industry may require integrity and/or traceability. Such conventional container security systems provide the ability to detect whether the container has been tampered with by visual inspection of the seal. However, these conventional container security systems are subject to circumvention. For example, the seal may be broken, the closure removed, the product in the container replaced, diluted, or stolen (e.g., during shipment), and the closure and seal then duplicated and replaced on the container such that the tampering with the product goes undetected.

Accordingly, it would be desirable to provide an improved closure security system for containers.

SUMMARY

According to one embodiment, a closure system includes: a closure chassis that is configured, when coupled to a container chassis, to prevent movement of a material between a container volume defined by the container chassis and an exterior of the container chassis via a first aperture defined by the container chassis; a first sensor subsystem that is coupled to the closure chassis and that is configured to generate a first sensor signal when the closure chassis experiences a tamper event; a first type communication interface housed in the closure chassis; a first processing system that is housed in the closure chassis and that is coupled to the first type communication interface and the first sensor subsystem; and a first memory system that is housed in the closure chassis and that includes instruction that, when executed by the first processing system, causes the first processing system to provide a first security engine that is configured to: receive a first sensor signal indicating that the closure chassis has experienced the tamper event; and provide, in response to receiving the first sensor signal using the first type communication interface, a first notification to a corresponding first type communication interface that the closure chassis has experienced the tamper event.

Figure 1:
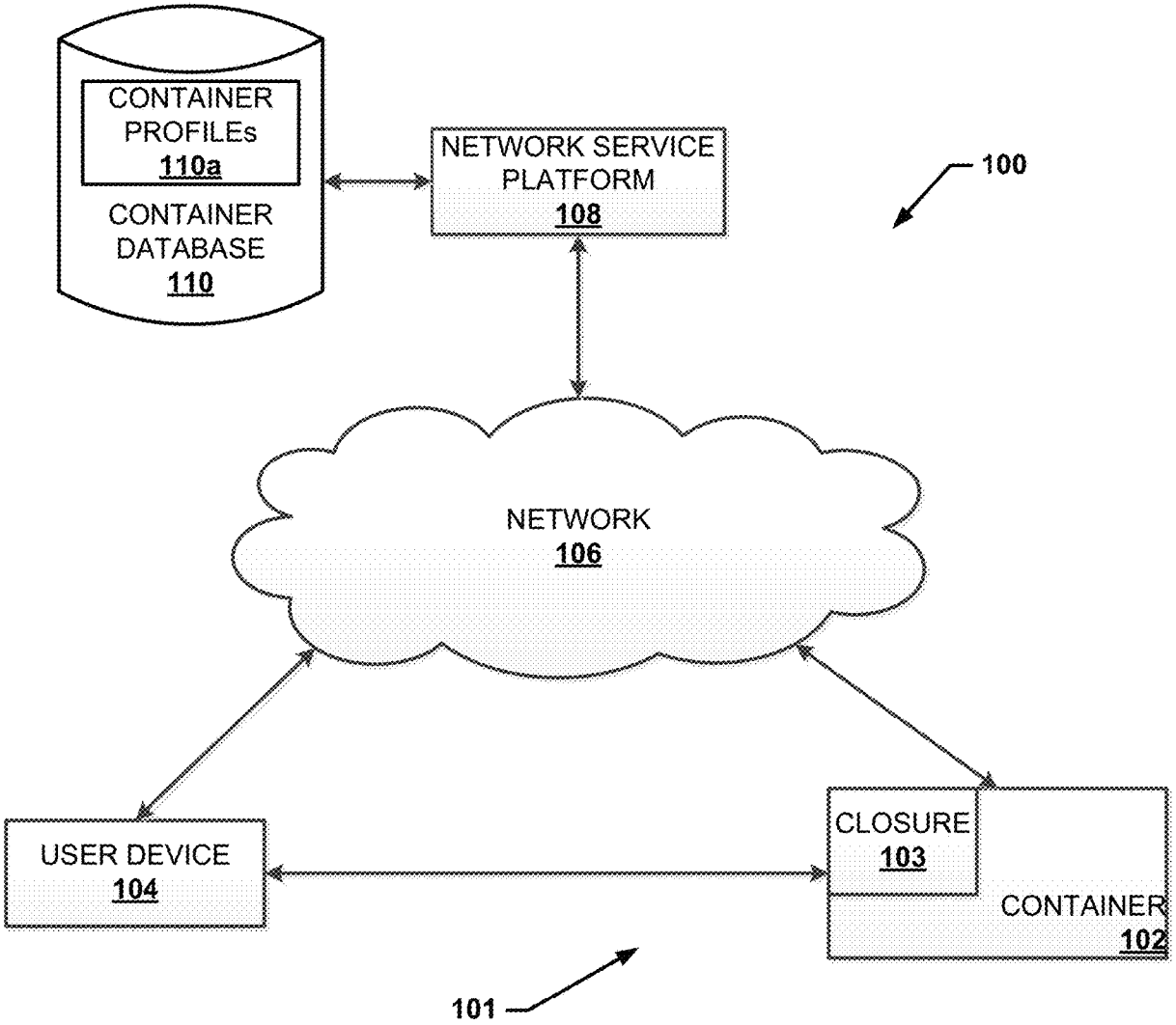
FIG. 1 is a schematic view illustrating an embodiment of a networked container system.

Embodiments of the present disclosure may be understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

Embodiments of the present disclosure include closure security systems for container systems, as well as methods for providing container security, that may be used to track containers while maintaining the integrity of the product within the container. As discussed above, existing seals and closures for containers do not prevent tampering with the containers and products provided within those containers, as it has been found that the conventional closures and seals are easily reproduced and replaced on tampered-with containers such that it is difficult for legitimate parties (e.g., a container manufacturer, a container filler, a container transporter, a container end user, and other parties) associated with the container to detect tampering with the closure and/or seal. The present disclosure proposes a novel closure security system that provides for the detection of whether a closure subsystem has experienced a tamper event such as, for example, the closure subsystem being removed from the container when closure subsystem is damaged, punctured, drilled, opened with or without authorization or replaced with or without authorization such that the contents of the container may be used, lost, diluted, stolen, leaked, replaced, contaminated, emptied or otherwise devalued. The container system can provide time and location data associated with any such tampering actions to a user device of a party of interest and/or a network service platform in a network environment accessible from any user device. Additional sensors may also be included in the closure subsystem and/or container system to provide data as to the status of the product being transported or stored in the container, as well as assist in inventory management. Examples of sensors may include depth measurement sensors, temperature sensors, humidity sensors, chemical agent sensors (to ensure authenticity of chemical products), orientation sensors, pressure sensors, movement sensors (e.g., an accelerometer), shock sensors, pH sensors, and/or any other sensors that may be used to detect tampering events and gather information about the container system, the closure subsystem, and/or the product within the container.

Container systems are often sealed on production, following cleaning, as well as after filling them with a product, which is intended to allow any owner of and/or party associated with the container system to ensure there is no container tampering or contamination of the product within by checking that the closure subsystem has not been tampered with (i.e., it is the same closure subsystem as the one that was provided on the container system after production, cleaning, and/or filling.) In various embodiments, the closure subsystem of the present disclosure may include a memory device that may be programmed with data such as a closure identifier, which may be encrypted. This closure identifier may be associated with a container identifier stored in a database, and may be read at any time during the container system's life cycle to confirm it is the expected closure identifier, and therefore the closure subsystem that was used to secure the container that is associated with the container identifier when the container was most recently sealed.

The closure subsystem may include a communication interface to communicate the container identifier to a user device or to a container module included in the container system. The container system may also include a container module that is separate from the closure subsystem and that is configured to communicate the status of the closure subsystem to a user device, a network service platform, and/or a user. In some embodiments, the container module may be separate from the closure subsystem for several reasons. For example, the location of the container may be tracked with the container module. Furthermore, the closure subsystem may be designed to be destroyed during removal, and therefore may lose its ability to communicate. Further still, the closure subsystem may have a small form factor, and this constraint may restrict the battery capacity, antenna performance, and other attributes, which necessitates the separate container module with a separate secondary communication interface where such constraints are no longer present. Further still, the cost of the components (e.g., tamper detection mechanisms) in the closure subsystem may be less expensive than the components (e.g., communication components) in the container module, making the separation of these modules relatively more cost-effective.

As such, in various embodiments, the closure subsystem may include a Near Field Communication (NFC) device, Bluetooth (BT) device, and/or a variety of other short range, low energy, peer-to-peer communication interfaces that would be apparent to one of skill in the art in possession of the present disclosure. For example, the NFC device may contain encrypted information regarding the container system such as the identity of the container system/closure subsystem, a time and a date of filling the container system with product contents, serial numbers for the product, and/or any other information about the product, the container system, the container module, the closure subsystem, and/or any other characteristic of the system components/contents. This information may be available to the BT device and may be communicated to the container module via the BT device and/or any other device with a BT receiver. In some examples, the container module may be used to provide a notification that a closure subsystem has been tampered with by providing that notification over a wide area network using a longer-range communication interface than any of those available in the communication interface of the closure subsystem in response to, for example, the closure subsystem detecting an event, a request for verification on the container system, the closure subsystem, and/or the product provided in the container, and/or in a variety of other scenarios that would be apparent to one of skill in the art in possession of the present disclosure.

Referring now to FIG. 1, an embodiment of a networked container system 100 is illustrated. In the illustrated embodiment, the networked container system 100 includes a container system 102 provided in a physical environment 101. In various embodiments, the container system 102 may include a bottle, a drum, a barrel, a bulk container, a jar, and/or any other containers that may benefit from the teachings of the present disclosure and that would be apparent to one of skill in the art in possession of the present disclosure. The physical environment 101 may be any indoor or outdoor space that may be contiguous or non-contiguous. For example, the physical environment 101 may include a yard, a warehouse, a business, a factory, a transit route, a transport vehicle, and/or any other space known in the art. The physical environment 101 may be defined by geofencing techniques that may include specific geographic coordinates such as latitude, longitude, and/or altitude, and/or may operate within a range defined by a wireless communication signal.

In various embodiments, the container system 102 may utilize a computer system such as the computer system 500 discussed below with reference to FIG. 5, and/or components of the computer system 500. The container system 102 may include communication units having one or more transceivers that enables communication with a closure subsystem 103, discussed in further detail below, a user device 104, a network service platform 108, other container systems, and/or any other device that would be apparent to one of skill in the art in possession of the present disclosure. Accordingly and as disclosed in further detail below, the container system 102 may perform direct or indirect communication with the closure subsystem 103, the user device 104, and/or other container systems. As used herein, the phrase "in communication" (and including variances thereof) is intended to encompass direct communication, as well as indirect communication through one or more intermediary components, and does not require direct physical (e.g., wired and/or wireless) communication and/or constant communication, but rather may include selective communication at periodic or aperiodic intervals, as well as one-time events.

For example, the container system 102 in the networked container system 100 of FIG. 1 may include first (e.g., long-range) transceiver(s) to permit the container system 102 to communicate with a network 106 (e.g., a wide area network (WAN)). The network 106 may be implemented by a mobile cellular network such as, for example, a long-term evolution (LTE) network or other third generation (3G), fourth generation (4G), or fifth-generation (5G) wireless networks. However, in some examples, the network 106 may be additionally or alternatively be implemented by one or more other communication networks such as, but not limited to, a satellite communication network, a microwave radio network, and/or any other communication networks that would be apparent to one of skill in the art in possession of the present disclosure.

The container system 102 and/or the closure subsystem 103 may also include second (e.g., short-range) transceiver(s) to allow the container system 102 and/or the closure subsystem 103 to communicate with each other, the user device 104, and/or other container systems. In the example illustrated in FIG. 1, such second transceivers are implemented by a type of transceiver supporting relatively short-range (i.e., operating at distances that are shorter than those utilized by the long-range transceivers) wireless networking communications. For example, such second transceivers may be implemented by Wi-Fi transceivers (e.g., via a Wi-Fi Direct protocol), Bluetooth® transceivers, Bluetooth® low energy (BLE) transceivers, infrared (IR) transceivers, Near Field Communication (NFC) transceivers, Zigbee® transceivers, radio-frequency identification (RFID) tags, ANT transceivers, Z-Wave® transceivers, and/or any other transceivers that are configured to allow the container system 102 and/or the closure subsystem 103 to intercommunicate via an ad-hoc and/or other wireless network.

In various embodiments below, the user device 104 is described as a mobile computing device such as laptop/notebook computing devices, tablet computing devices, mobile phones, and wearable computing devices. However, in other embodiments, the user device 104 may be provided by desktop computing devices, server computing devices, and/or a variety of other computing devices that would be apparent to one of skill in the art in possession of the present disclosure. The user device 104 may include a communication unit having one or more transceivers to enable the user device 104 to communicate with the network service platform 108 and the container system 102 via the network 106, and/or to communicate with the container system 102 and/or the closure subsystem 103 via a short-range wireless network. Accordingly, and as disclosed in further detail below, the user device 104 may perform direct and/or indirect communications with the container system 102 and/or the closure subsystem 103.

The networked container system 100 also includes and/or may be in communication with a network service platform 108. For example, the network service platform 108 may include one or more server devices, storage systems, cloud computing systems, and/or other computing devices (e.g., desktop computing device(s), laptop/notebook computing device(s), tablet computing device(s), mobile phone(s), etc.). As discussed below, the network service platform 108 may be coupled to a container database 110 that is configured to provide repositories such as a container repository of container profiles 110*a* for container systems 102 within the physical environment 101. For example, the container database 110 may store a plurality of container profiles 110*a* that each include a container identifier and information associated with the container (e.g., events, product information, sensor information, and/or any other information that would be apparent to one of skill in the art in possession of the present disclosure). Furthermore, each container profile 110*a* may include an associated closure identifier that is associated with the container identifier in order to pair, link, or otherwise associate closure subsystems with containers in the container systems.

Figure 2A:
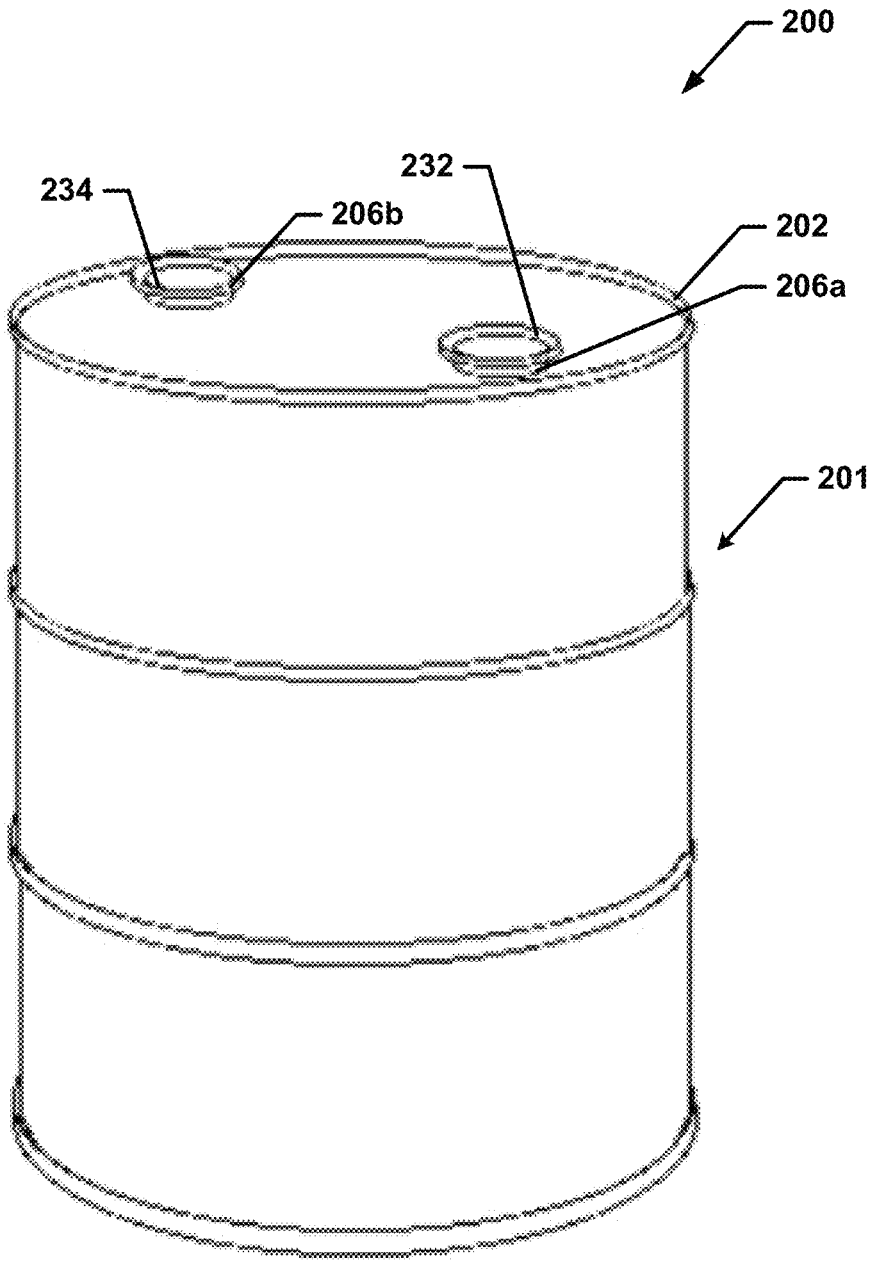
FIG. 2A is a perspective view illustrating an embodiment of a container system that may be provided in the networked container system of FIG. 1.
Figure 2B:
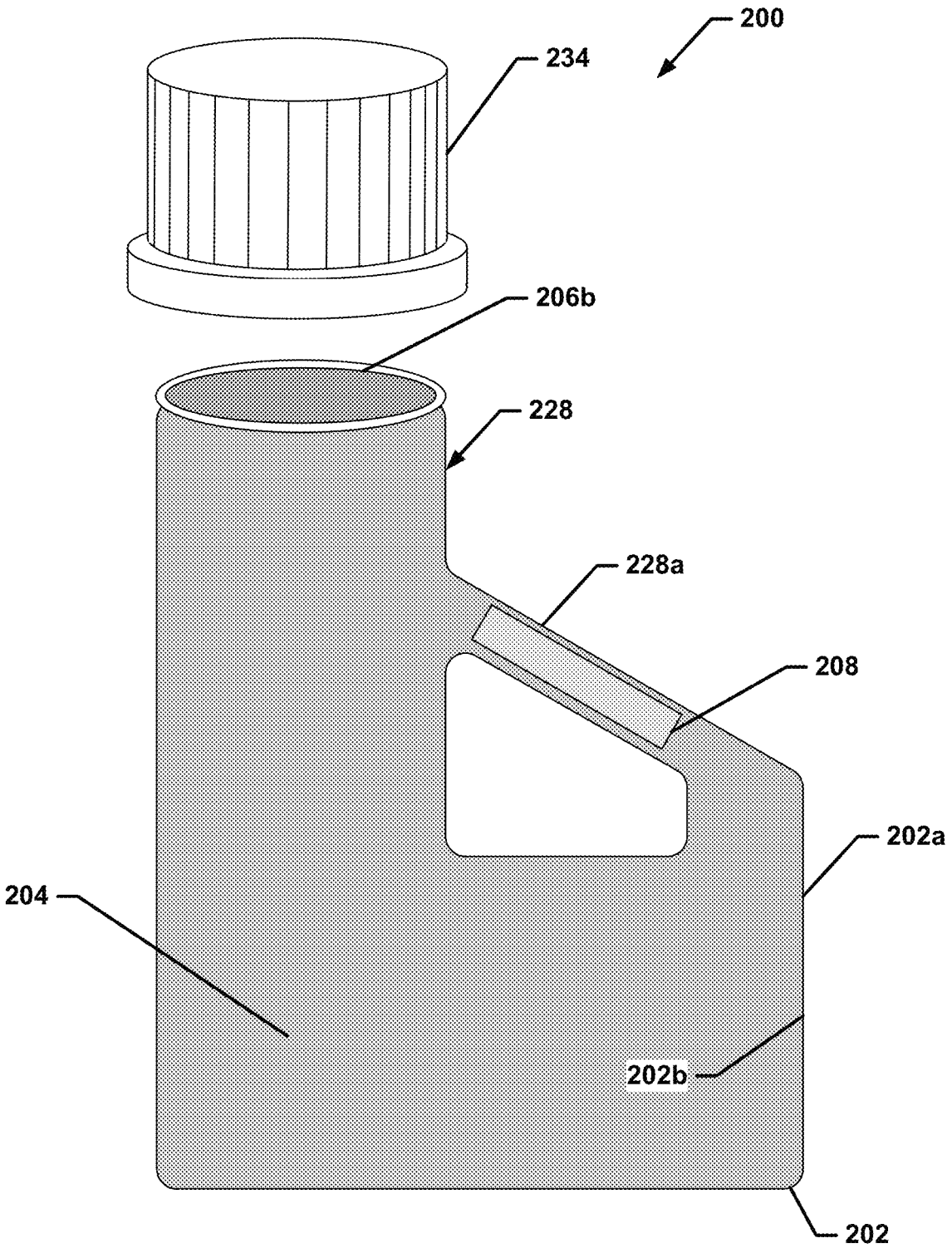
FIG. 2B is a perspective view illustrating an embodiment of a container system that may be provided in the networked container system of FIG. 1.
Figure 2C:
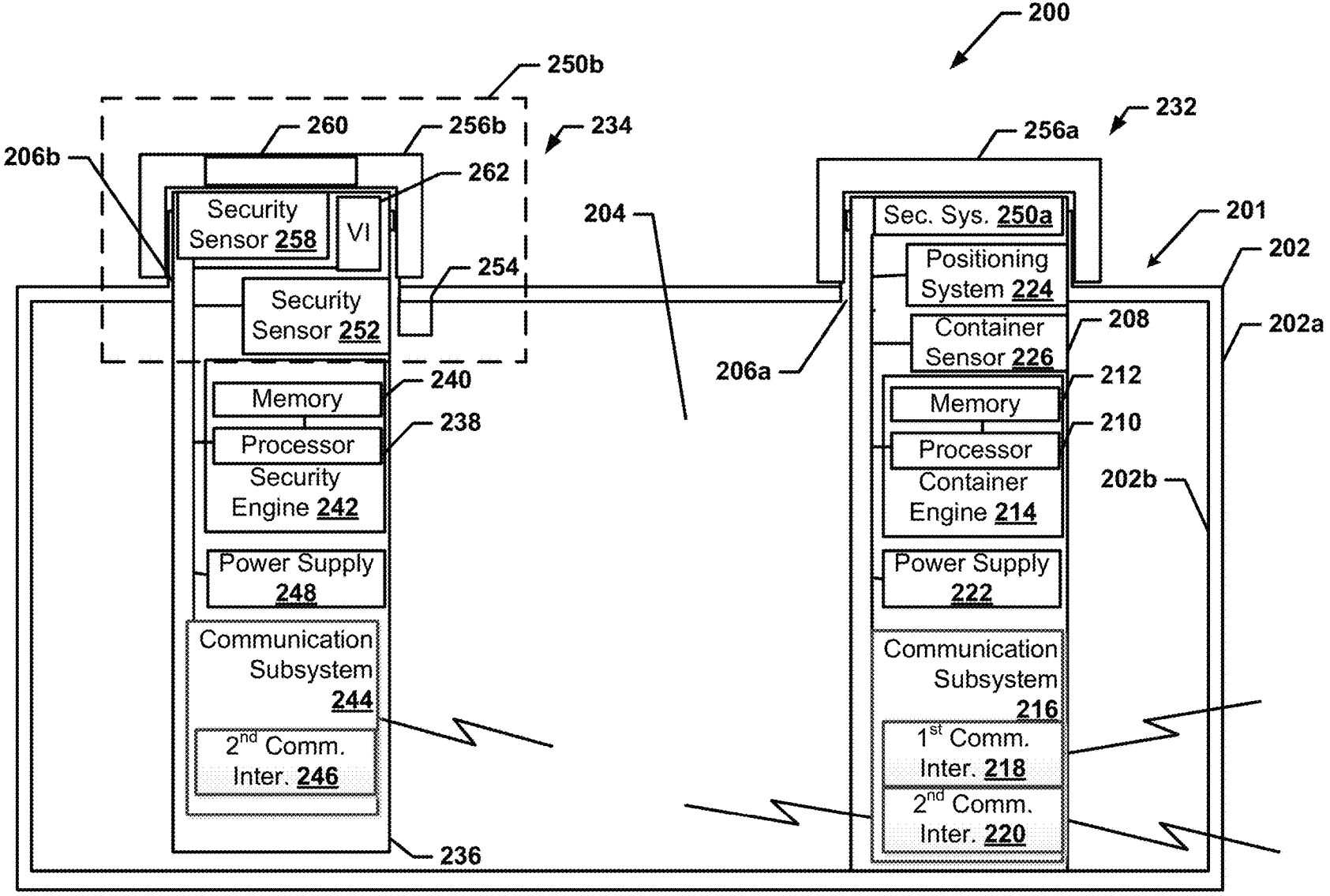
FIG. 2C is a schematic view illustrating an embodiment of the container system of FIG. 2A and FIG. 2B.

Referring now to FIGS. 2A, 2B, and 2C, various embodiments of a container system 200 are illustrated. In various embodiments, the container system 200 may be the container system 102 discussed above with reference to FIG. 1. The container system 200 includes a container 201 having container chassis 202 that defines a container volume 204 and one or more apertures 206*a* and 206*b* that may provide for the storage of products in the container volume 204. The container chassis 202 may also house the components of the container system 200, only some of which are illustrated in FIG. 2C. For example, the container chassis 202 may house a container module 208 that includes a processing system 210 and a memory system 212. The memory system 212 is coupled to the processing system 210 and may include instructions that, when executed by the processing system 210, cause the processing system 210 to provide a container engine 214 that is configured to perform the functionality of the container engines and container systems, as well as any other functionality, discussed below.

The container module 208 and/or container chassis 202 may further house a communication subsystem 216 that is coupled to the container engine 214 (e.g., via a coupling between the communication subsystem 216 and the processing system 210). The communication subsystem 216 may include software or instructions that are stored on a computer-readable medium and that allow the container system 200 to send and receive information through the communication networks described herein. For example, the communication subsystem 216 may include a communication interface 218 (e.g., first (e.g., long-range) transceiver(s)) to provide for communications through the communication network 106 as detailed above. In an embodiment, the communication interface 218 may include a wireless antenna that is configured to provide communications via IEEE 802.11 protocols (Wi-Fi), cellular communications, satellite communications, other microwave radio communications, and/or utilizing any other communication techniques that would be apparent to one of skill in the art in possession of the present disclosure. The communication subsystem 216 may also include a communication interface 220 (e.g., second (e.g., short-range) transceiver(s)) that is configured to provide direct communication with user devices, sensors, closure subsystems, and other devices within the physical environment 101 discussed above with respect to FIG. 1. For example, the communication interface 220 may be configured to operate according to wireless protocols such as Bluetooth®, Bluetooth® Low Energy (BLE), near field communication (NFC), infrared data association (IrDA), ANT®, Zigbee®, Z-Wave® IEEE 802.11 protocols (Wi-Fi), and/or any other wireless communication protocols that allow for the direct device communication described herein.

The container chassis 202 and/or container module 208 also houses a power supply system 222 that may include and/or be configured to couple to a battery. For example, the power supply system 222 may include an integrated rechargeable battery that may be recharged in the container chassis 202 using methods known in the art, and/or may include other power sources that would be apparent to one of skill in the art in possession of the present disclosure. In some embodiments, the user device 104 discussed above with reference to FIG. 1 may be configured to couple to the container chassis 202 (e.g., via a port system that includes a power port) that may provide for the recharging of a rechargeable battery included in the power supply system 222. In various embodiments, port systems may include a data port configured to communicate data between the container module 208 and the user device 104 (e.g., via a cable or other connector.) In other embodiments, the power supply system 222 may be configured to accept a replaceable, non-rechargeable battery while remaining within the scope of the present disclosure as well.

In various embodiments, the container chassis 202 and/or the container module 208 may also include a positioning system 224 that is coupled to the container engine 214. The positioning system 224 may include sensors that are configured to determine their current location and position. For example, the positioning system 224 may include a global positioning system (GPS) receiver, a real-time kinematic (RTK) GPS receiver, a differential GPS receiver, a Wi-Fi based positioning system (WPS) receiver, an accelerometer, and/or a variety of other positioning systems and components that would be apparent to one of skill in the art in possession of the present disclosure. In various embodiments, the container chassis 202 and/or the container module 208 may include one or more container sensors 226 that are coupled to the container engine 214 and configured to provide for the monitoring of conditions of the product and/or the container such as, for example, depth measurement sensors, load sensors, temperature sensors, humidity sensors, chemical agent sensors (e.g., to ensure authenticity of the product), orientation sensors, pressure sensors, movement sensors (e.g., an accelerometer), shock sensors, pH sensors, and/or any other sensors that would be apparent to one of skill in the art in possession of the present disclosure. The container sensors 226 may provide an indication that a tamper event has occurred, as discussed below, to the container and/or any other information about the product, container, and/or closure included with the container that would be apparent to one of skill in the art in possession of the present disclosure.

In various embodiments, the container module 208 may be housed in the container chassis 202 such as, for example, within the container volume 204 defined by the container chassis 202, within a chassis wall of the container chassis 202, and/or affixed or secured to an outside of the container chassis 202. For example, in FIG. 2B, the container system 200 may include a bottle container 228 that has a handle portion 228*a* within which the container module 208 is disposed. However, as discussed above, the container module 208 may also be attached to an exterior wall 202*a* that is opposite the container chassis 202 from an interior wall 202*b* that defines the container volume 204. In yet other embodiments, the container module 208 may be provided as a first closure subsystem 232, as illustrated in FIGS. 2A and 2C, that may include some or all of the components of a second closure subsystem 234, discussed below, such as the security system 250*a* that includes one or more security sensors and/or the seal 256*a* illustrated in FIG. 2C. In yet other embodiments where a plurality of containers are being shipped together or another container is within communication range of the container chassis 202, the container module 208 may be housed in one of the containers and provide for communication with the other containers, forming a mesh or other type of local network. In various other embodiments, the container module 208 may be housed in a shipping container and/or shipping platform that includes the container chassis 202.

In various embodiments, the second closure subsystem 234 may include caps, plugs, tops, valves, lids, and/or other closure components that would be apparent to one of skill in the art in possession of the present disclosure. The second closure subsystem 234 may include a closure chassis 236 that is configured, when coupled to the container chassis 202, to prevent movement of the product from the container volume 204 and out to the exterior of the container chassis 202 via the aperture 206*a* and/or 206*b*. The closure chassis 236 may house a processing system 238 and a memory system 240 that is coupled to the processing system 238 and may include instruction that, when executed by the processing system 238, cause the processing system 238 to provide a security engine 242 that is configured to perform the functionality of the security engines and closure subsystems, as well as any other functionality, discussed below. While a processing system 238 and a memory system 240 are discussed as providing the security engine 242, the security engine 242 may be provided by application specific integrated circuits (ASICs), field-programmable gate arrays (FPGAs), complex programmable logic devices (CPLDs) and/or any other hardware circuit that may be configured to cause a communication interface, discussed below, to provide a notification in response to a security sensor signal being generated by a security sensor.

The closure chassis 236 may further house a communication subsystem 244 that is coupled to the security engine 242 (e.g., via a coupling between the communication subsystem 244 and the processing system 238). The communication subsystem 244 may include software or instructions that are stored on a computer-readable medium and that provide for the sending and receiving of information through the communication networks discussed above. For example, the communication subsystem 244 may also include a communication interface 246 (e.g., second (e.g., short-range) transceiver(s)) that is configured to provide direct communication with user devices, sensors, the container module 208, and other devices within the physical environment 101 discussed above with respect to FIG. 1. For example, the communication interface 246 may be configured to operate according to wireless protocols such as Bluetooth®, Bluetooth® Low Energy (BLE), near field communication (NFC), infrared data association (IrDA), ANT®, Zigbee®, Z-Wave®, IEEE 802.11 protocols (Wi-Fi), and/or other wireless communication protocols that allow for direct communication between devices.

The closure chassis 236 may also house a power supply system 248 that may include or be configured to couple to a battery. For example, the power supply system 248 may include an integrated rechargeable battery that may be recharged in the closure chassis 236 using methods known in the art, and/or may include other power sources that would be apparent to one of skill in the art in the art in possession of the present disclosure. In some embodiments, the user device 104 discussed above with reference to FIG.

1 may be configured to couple to the closure chassis 236 (e.g., via a port system that includes a power port) and, in some cases, recharge a rechargeable battery included in the power supply system 248. In various embodiments, port systems may be provided that include a data port configured to communicate data between the closure subsystem 234 and the user device 104 (e.g., via a cable or other connector.) In other embodiments, the power supply system 248 may be configured to accept a replaceable, non-rechargeable battery while remaining within the scope of the present disclosure as well.

In various embodiments, the closure subsystem 234 may include a closure security system 250*b* that may include a closure security sensor 252 that is configured to provide a closure sensor signal when the closure subsystem 234 experiences a tamper event such as when the closure subsystem 234 is removed from the aperture 206*b*. For example, the closure security sensor 252 may be configured to provide a signal to the security engine 242 that indicates that the container chassis 202 and the closure chassis 236 have moved relative to each other (e.g., by some minimum distance) from a first (e.g. sealed) configuration to a second (e.g., unsealed) configuration. In specific embodiments, the container chassis 202 may house a magnet 254, and the closure security sensor 252 may include a Hall effect sensor that is configured to perform at least some of the functionality discussed above, although other sensors are envisioned as falling within the scope of the present disclosure as well.

In another example, the closure security system 250*b* may include a seal 256*b* that may include a device or substance that is configured to join the container chassis 202 and the closure chassis 236 together so as to resist them from coming apart and/or to prevent the product in the container volume 204 from passing between the container chassis 202 and the closure chassis 236. The closure chassis 236 may alternatively or additionally house a seal security sensor 258 that is configured to provide a seal sensor signal to the security engine 242 when the seal 256*b* experiences the tamper event such as when the seal 256*b* is removed from the closure chassis 236 and the container chassis 202. For example, the seal 256*b* may include an RFID tag 260 that may store a closure identifier (e.g., a seal identifier that is associated with the container system 200 and/or a container identifier stored in the container database 110) that identifies a container profile 110*a*. The seal security sensor 258 may include a RFID reader that is configured to provide the seal sensor signal to the security engine 242 when the seal 256 that includes the RFID tag 260 is removed from the closure chassis 236 and container chassis 202 (e.g., by a distance that prevents the reading of the RFID tag 260.) In another example, the seal security sensor 258 may include an NFC reader that may read an NFC tag in the seal 256*b* that includes an identifier (e.g., associated with the container system 200 and/or a container identifier stored in the container database 110) that identifies a container profile 110*a*. As such, the NFC reader may be configured to detect when the seal 256*b* is removed from the closure chassis 236 and container chassis 202 more than a relatively short distance (e.g., less than 10 cm.)

In another example, the seal security sensor 258 and/or the closure security sensor 252 may experience a tamper event when either the seal security sensor 258 and/or closure security sensor 252 is damaged. For example, an unscrupulous party may drill a hole into the closure chassis 236 without removing the closure chassis 236 or the seal 256*b*. The seal security sensor 258 and/or the closure security sensor 252 may be positioned within the closure chassis 236 and configured to provide a seal sensor signal, a closure sensor signal, and/or lack thereof if any one of the seal security sensor 258 and/or the closure security sensor 252 are damaged such as when the unscrupulous party damages one of the sensors 258 and/or 252 and/or other container sensors 226 while drilling into the closure chassis 236 or otherwise puncturing the closure chassis 236. Furthermore, pressure sensors in the container chassis 202 or closure subsystem 234 may detect a pressure drop in response to such accesses of the container housing (e.g., via drilling through the closure subsystem or container chassis), and that pressure drop may be interpreted as a tampering event as well.

In various embodiments, the closure security system 250*b* may also include one or more visual indicators 262 that may be provided on the exterior of the closure chassis 236 such that when a security sensor signal is received from the closure security sensor 252, a first visual indicator (e.g., a light emitting diode (LED)) may illuminate to provide a visual indication that the security sensor signal has been generated. Similarly, the first visual indicator or a second visual indicator may illuminate when the seal sensor signal has been generated. However, embodiments in which no visual indications are provided of security sensor signal receipt or generation will fall within the scope of the present disclosure as well. While a specific embodiment of the container system 200 and the closure subsystem 234 is illustrated and described herein, one of skill in the art in possession of the present disclosure will recognize that a wide variety of modification to the components and configuration of the container system 200 and the closure subsystem 234 will fall within the scope of the present disclosure as well.

While the embodiment illustrated in FIG. 2C illustrates a single closure subsystem 234, one of skill in the art in possession of the present disclosure will recognize that a container system may include any number of apertures that need a closure, and thus any number of closure subsystems may be provided with such multi-aperture containers, with each configured to communicate with the container module 208 substantially as discussed below.

Figure 3:
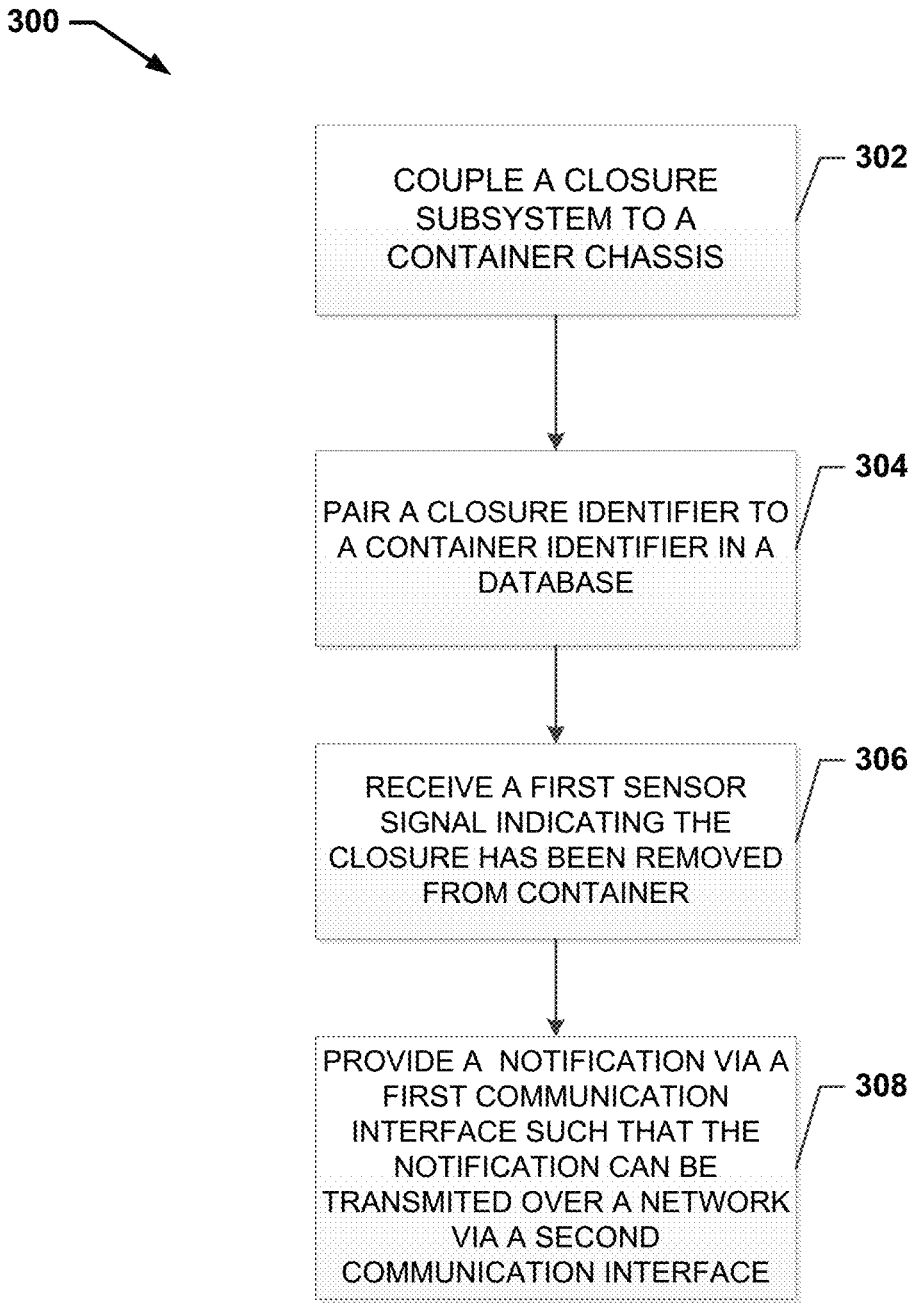
FIG. 3 is a flow chart illustrating an embodiment of a method for providing container security.

Referring now to FIG. 3, a method 300 for providing container security is illustrated. The method 300 begins at block 302 where a closure subsystem is coupled to a container chassis of a container system such that the closure subsystem prevents movement of a material stored in a container volume defined by the container chassis and out to an exterior of the container chassis via a first aperture defined by the container chassis. In an embodiment of block 302, the closure subsystem 234 may be coupled to the container chassis 202. In one example, the closure subsystem 234 may be a plug that is inserted into the aperture 206*b* and that is configured to prevent movement of materials located in the container volume 204 out of the container chassis 202 via the aperture 206*b*. In another example, the closure subsystem 234 may be a cap that is fitted over the aperture 206*b* and that prevents movement of materials located in the container volume 204 out of the container chassis 202 via the aperture 206*b*. However, the closure subsystem 234 may include a variety of closures that one of skill in the art in possession of the present disclosure would recognize would provide the functionality described herein.

The closure subsystem 234 may be coupled to the container chassis 202 during several stages of a container system's life cycle. For example, a container manufacture may couple the closure subsystem 234 to the container chassis 202 after manufacturing the container system 200 in order to prevent contaminates from entering the container volume 204 before the container system has reached a container filler (which may be particularly beneficial when the container volume 204 has been sterilized.) Furthermore, a second closure subsystem 234 may be also be coupled to the container chassis 202 after the container filler has received the container system 200 and removed the first closure subsystem 234 to fill the container volume 204 with a product in order to prevent contaminants from contaminating the product and/or to prevent the product from escaping (or being removed from) the container volume 204 via the aperture 206*b* during transport of the container system 200 to an end user. Further still, the end user may remove the second closure subsystem 234 to retrieve the product from the container volume 204, and may replace the second closure subsystem 234 with a third closure subsystem 234 for tracking purposes and/or secure storage of any unused product (e.g., at the end user's facility.) The container chassis 202 may be returned to the container manufacturer or a container cleaning facility when the end user is finished with it, with or without a closure subsystem (e.g., because contamination and loss of the product is not typically a factor once the product has been dispensed from the container volume 206.)

In various embodiments of block 302, the seal 256*b* may be additionally coupled to the closure chassis 236 and the container chassis 202. As discussed above, the seal 256*b* may be configured to join the container chassis 202 and the closure chassis 236 together so as to prevent them from being detached and/or to prevent of the product from passing between the container chassis 202 and the closure chassis 236.

The method 300 may then proceed to block 304 where at least one closure identifier of the closure subsystem is paired with a container identifier of the container. In an embodiment of block 304, a closure identifier of the closure subsystem 234 may be paired with a container identifier of the container 201. For example, the user device 104 and/or the network service platform 108 may be used to enter the container identifier of the container 201, the closure identifier of the closure subsystem 234, and/or any other information as part of a container profile 110*a* that is stored in the container database 110 (e.g., local to the user device 104 and/or via the network service platform 108.) In various examples, the closure identifier and/or the container identifier may include tokens, characters, strings, or any identifiers for differentiating a closure subsystem from another closure subsystem and a container from another container. For example, the closure identifier and the container identifier may include internet protocol addresses, network addresses, media access control (MAC) addresses, universally unique identifiers (UUIDs), phone numbers, and/or any other identifier that may be used to identify the closure subsystem 234. In various embodiments, the closure identifier may include a seal identifier of the seal 256 (e.g., an RFID identifier), an identifier of the communication interface 246 housed in the closure chassis 236 (e.g., a UUID of a BT communication interface), identifiers such as serial numbers stored in the memory 240 that provides by the security engine 242, and/or any other identifier that may be electronically provided and, in some cases, encrypted. Similarly, when the container module 208 is housed in the container chassis 202, the container identifier may include any identifier of the communication interfaces 218 and/or 220, an identifier stored in the memory 212 and/or other mass storage device included in the container module 208, a QR code that is attached to the container chassis 202, a serial number, and/or any other identifiers that would be apparent to one of skill in the art in possession of the present disclosure.

In various embodiments, any other information about the container system 200, the container module 208, the closure subsystem 234, the product stored within the container, parties associated with the container, location data, sensor data, and/or other information that would be apparent to one of skill in the art in possession of the present disclosure, may be stored and associated with the closure identifier and the container identifier as part of the container profile 110*a*.

Figure 4A:
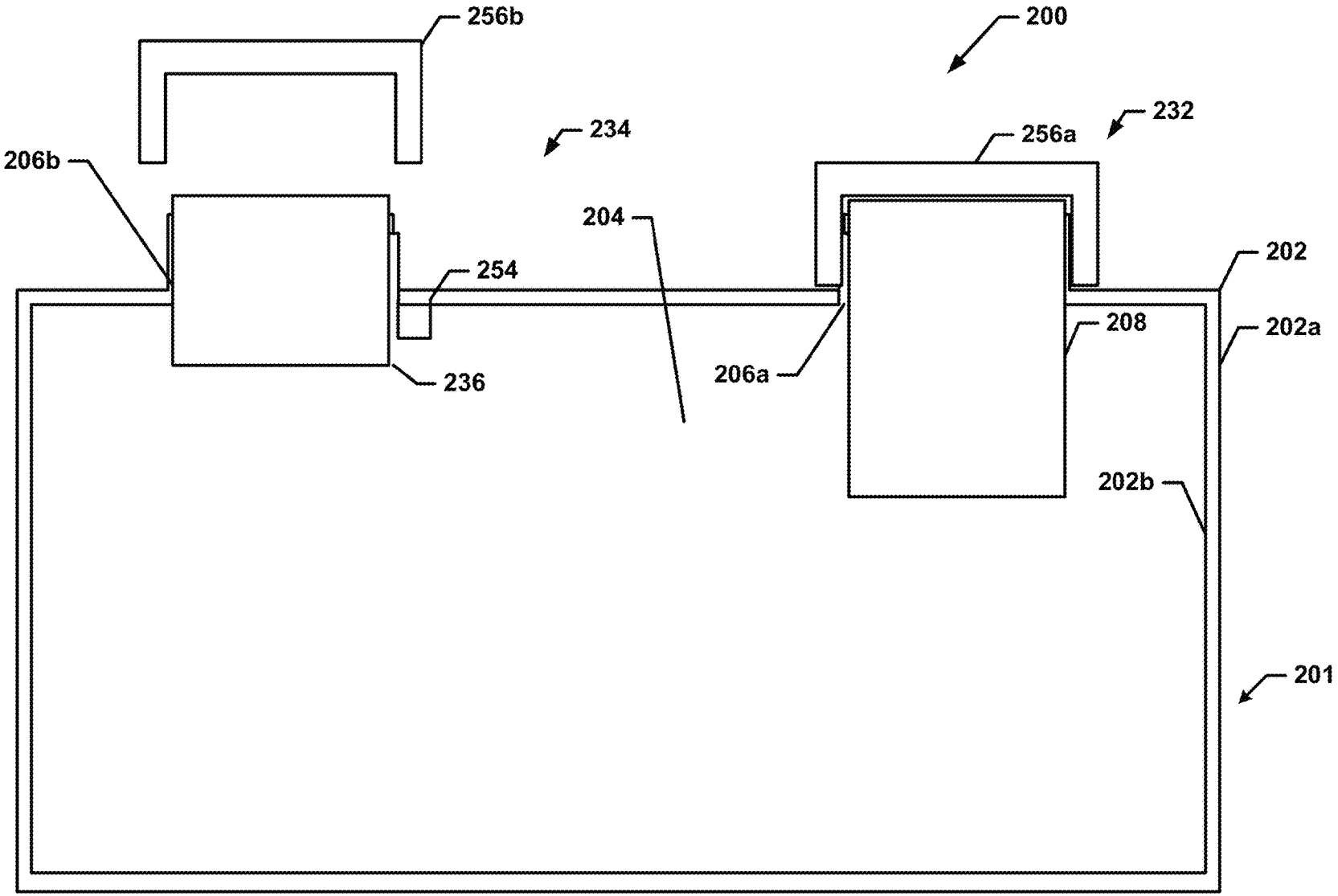
FIG. 4A is a perspective view illustrating an embodiment of the container system of FIGS. 2A and 2C during the method of FIG. 3.
Figure 4B:
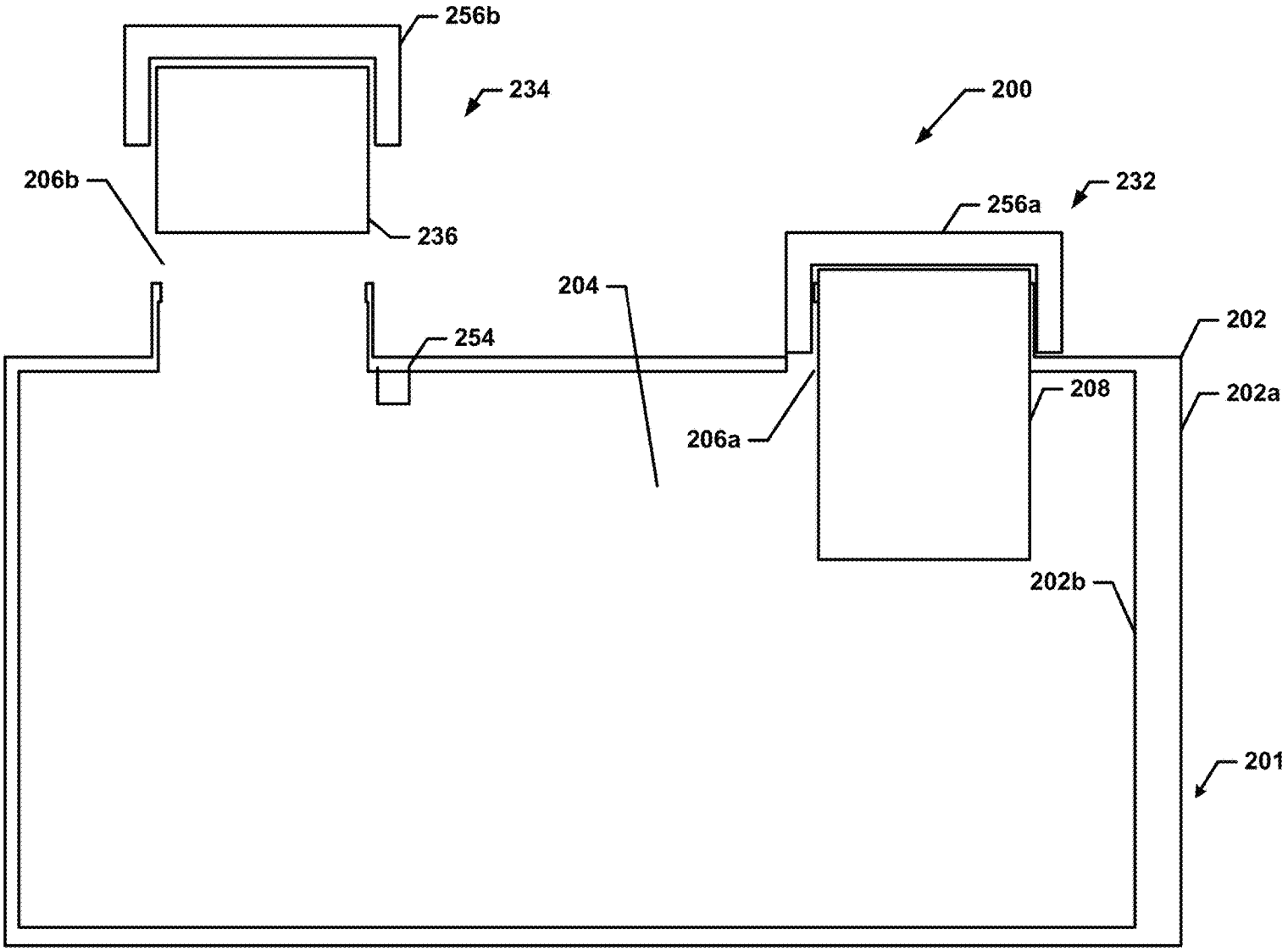
FIG. 4B is a perspective view illustrating an embodiment of the container system of FIGS. 2A and 2C during the method of FIG. 3.

The method 300 may then proceed to block 306 where the closure subsystem detects a security sensor signal. In an embodiment of block 306, the security engine 242 may detect a security sensor signal indicating a tamper event has occurred. For example, and as illustrated in FIG. 4A, the security engine 242 may detect a seal sensor signal provided by the seal security sensor 258 when the seal 256*b* has been removed from the closure chassis 236 and the container chassis 202 (e.g., by some minimum distance such as an RFID or NFC readable distance.) In another example, and as illustrated in FIG. 4B, the closure security sensor 252 may provide the security sensor signal to the security engine 242 when the closure security sensor 252 detects that the closure chassis 236 has been removed from the container chassis 202 (e.g., whether or not the seal 256*b* has been removed from the closure chassis 236) by some minimum distance. In another example, the closure security sensor 252 and/or the seal security sensor 258 may provide the closure sensor signal and/or the seal security sensor signal, respectively if either of the closure security sensor 252 and/or the seal security sensor 258 are damaged in any way. In various examples, the seal sensor signal and the closure sensor signal may be distinct signals generated by separate sensors, and may be independently generated based on which of the seal 256*b* and/or the closure is removed, and thus may provide different information. Thus, if the seal 256*b* were also removed from the closure chassis in FIG. 4B, the seal security sensor 258 would generate a seal sensor signal that is separate from the closure sensor signal. However, in other examples, the seal sensor signal and the closure sensor signal may be the same signal generated by the same sensor. In various other examples, a tamper event may be detected by any of the other container sensors 226 such as a change in pressure by a pressure sensor indicating a puncture in the container chassis 202, a change in pH by a pH sensor indicating a diluted solution, and other sensors discussed above that may provide a security sensor signal to the security engine 242. In various embodiments, the security sensor signal and/or the seal sensor signal may include an identifier that is associated with the closure security sensor 252 and the seal security sensor 258, respectively, and/or identifier(s) associated with the closure subsystem 234 and/or any other information regarding the container subsystem, the product, the parties associated with the container, the container module, and/or other information that would be apparent to one of skill in the art in possession of the present disclosure.

The method 300 may then proceed to block 308 where, in response to detecting the security sensor signal by the closure subsystem, a notification is provided via a first type communication system that the closure subsystem has been moved relative to the first aperture. In an embodiment of block 308, a security sensor signal (e.g., the closure sensor signal from the closure security sensor 252, the seal sensor signal from the seal security sensor 258, and/or any security sensor signals from other sensors 226 that may be housed in the closure chassis) may cause the security engine 242 to generate a notification that is communicated over the communication interface 246 to the communication interface 220 of the container module 208. However, in other embodiments, the communication interface 246 of the communication subsystem 244 may provide the notification to the user device 104 that is within range of the communication interface 246. In other embodiments, the security engine 242 may store the notification in the memory 240 and/or other storage devices included in the closure subsystem 234 until the communication subsystem 244 is within range of a device/communication interface with which the communication interface 246 can communicate.

In examples where the notification is provided to the communication interface 220, the container engine 214 may cause the communication interface 218 to provide the notification over the network 106 to the user device 104 and/or the network service platform 108. In another embodiment, the container engine 214 may store the notification in the memory 212 or other storage device (e.g., in the event that communications between the network 106 and the communication interface 218 are unavailable and/or there is no user device 104 in direct communication with the communication interface 220.) For example, if the container system 200, while being transported, is taken to a location where cellular service for the communication interface 218 is unavailable, and then one of the seal 256*b* and/or the closure chassis 236 is removed from the container system 200 to cause a security sensor signal to be generated, the resulting notification may be stored by the container module 208 until the container system 200 determines it can communicate that signal through the network 106 via an available cellular service.

The notification provided at block 308 may include at least a closure identifier, a seal identifier, and/or any other identifier associated with the closure subsystem 234. However, in other examples, the notification may include a time at which the security sensor generated the signal, a location where that signal was generated (e.g., determined via the positioning system 224), any container sensor data gathered from the container sensors 226, any container module identifiers, any container identifiers, product information, and any other information that would be apparent to one of skilled in the art in possession of the present disclosure.

The notification provided at block 308 may allow the network service platform 108 to use the closure subsystem identifier therein to locate the corresponding container profile 110*a* in the container database 110 and log any of the information that is included in that notification. In response to receiving the notification at block 308, the network service platform 108 may also provide an alert to any of the parties associated with the container system 200 such as, for example, providing an alert to a user device 104 that is associated with the container system 200, which may notify an administrator of the security event detected by the closure security system 250*b*. In other embodiments, when the user device 104 first receives the notification, the user device 104 may generate an alert through a user interface such as, for example, a graphical user interface alert, a vibration, a sound, and/or any other alert that would be apparent to one of skill in the art in possession of the present disclosure. The user device 104 may also provide the notification to the network service platform 108 to cause the network service platform to retrieve other information associated with the received closure subsystem identifier, and/or cause the network service platform 108 to log the security event in the container profile 110*a* for the container system 200 such that other parties and user devices 104 associated with the container system 200 may receive the alert as well.

In various embodiments, the security engine 242 may also cause the visual indicator 262 included in the closure security system 250*b* to activate and provide a visual indication on the exterior of the closure chassis 236 of the security event. For example, one or more LEDs may illuminate (or shut off) in response to one or more security sensor signals generated by the seal security sensor 258 and/or the closure security sensor 252. For example, a first LED may illuminate upon the security engine 242 receiving a closure sensor signal, and/or a second LED may illuminate in response to the security engine 242 receiving a seal sensor signal. In various embodiments, the visual indicator 262 may be provided in the container module 208 and/or other locations on the container chassis 202.

In various embodiments, the container sensors 226, such as a depth sensor, pressure sensor, and/or level sensor, may be used in conjunction with the closure security system 250*a* and/or 250*b* to perform a variety of other functions besides security. For example, the depth and/or pressure sensors of the container system 200 may be configured to cause the container module 208 to provide an indication to the network service platform 108 and/or user device 104 of a replacement of supply event (e.g., an indication to refill the product) and/or a collection event (e.g., collect the container system 200 for cleaning and reuse). Many container systems 200 may undergo multiple filling and re-use cycles and the automatic triggering of a collection notification once emptied and location of the container may be used to improve the reuse of the container system 200. In other examples, additional sales of the product within the container may be automated when the container system 200 is emptied and may be indicated by a level sensor that is activated once the closure security system 250*a* detects a tamper event. The level sensor may be an active sensor, and thus only activated after a tamper event is detected such that the level sensor does not drain the battery included in the power supply 222 and/or 248.

In a specific example utilizing the systems and methods of the present disclosure, the closure in the container system that includes the closure chassis 236 and/or the seal 256*b* may include an RFID tag or similar intelligent tag that stores encrypted information including an encrypted identifier which is difficult to replicate or replace. A security sensor (e.g., closure security sensor 252 and/or seal security sensor 258) may be included in the closure chassis 236 and/or container chassis 202, and may include an RFID reader, which may read the RFID tag to verify nothing has changed with the seal 256*b* and/or the closure chassis 236 (i.e., verify that the RFID tag has not been replaced with another RFID tag that includes a different RFID identifier than what is expected and/or that the original RFID tag has been continually present). The RFID reader may be configured to broadcast the encrypted information included in the RFID tag to a standard interface such as a BT communication interface or a Wi-Fi communication interface housed within the closure chassis 236 and/or the container chassis 202 such that a dedicated identification reader (e.g., RFID reader) is not needed by an end user, and rather the end user can use a conventional mobile phone or other user device to determine whether a tamper event occurred with the container. This reduces barriers to entry and costs as the specific RFID reader is not required to receive information from the container system 200.

Thus, systems and methods have been described that provide for detection of closure subsystem removal from a container system, as well as the provisioning of a notification of a security event to parties that have an interest in that container system. The closure subsystem may include one or more security sensors that generate a security sensor signal when at least one of a closure or a seal is removed from the container system. The closure subsystem may communicate this security event to a container module via a second type communication interface such that the container module can communicate the event through a first type communication interface that has a longer range than the second type communication interface. The first type communication interface, because of its longer range, typically has greater power requirements, and thus is typically more expensive and greater in size and weight due to the need for larger batteries and circuits. Therefore, embodiments of the present disclosure provide a cost effective and power efficient system in situations where there are multiple apertures in the container system that need a disposable closure subsystem, situations where the container module does not include a security system, and/or situations where the container module is located within the container volume or exterior to the container chassis. As such, the container system may provide security for the container by monitoring and reporting theft of a product stored there, detecting and reporting events that may have caused contamination to the product or container, and/or other detecting and reporting any other events that occur to the container through its life cycle.

Figure 5:
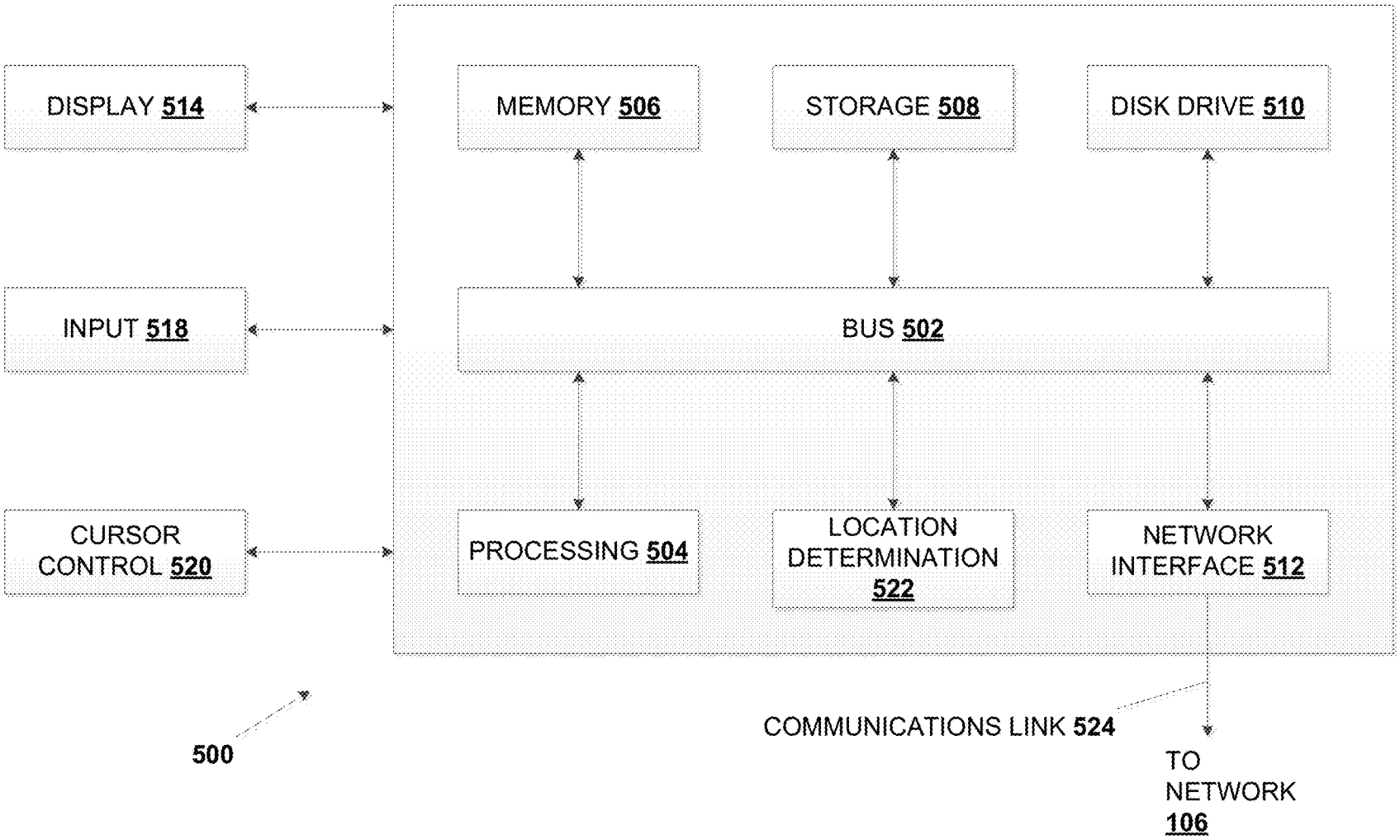
FIG. 5 is a schematic view illustrating an embodiment of a computer system.

Referring now to FIG. 5, an embodiment of a computer system 500 suitable for implementing, for example, the container system 102 and 200, the user device 104, and/or the network service platform 108, is illustrated. It should be appreciated that other devices utilized in the container network system discussed above may be implemented as the computer system 500 in a manner as follows.

In accordance with various embodiments of the present disclosure, computer system 500, such as a computer and/or a network server, includes a bus 502 or other communication mechanism for communicating information, which interconnects subsystems and components, such as a processing component 504 (e.g., processor, micro-controller, digital signal processor (DSP), etc.), a system memory component 506 (e.g., RAM), a static storage component 508 (e.g., ROM), a disk drive component 510 (e.g., magnetic or optical), a network interface component 512 (e.g., modem or Ethernet card), a display component 514 (e.g., CRT or LCD), an input component 518 (e.g., keyboard, keypad, or virtual keyboard), a cursor control component 520 (e.g., mouse, pointer, or trackball), and/or a location determination component 522 (e.g., a Global Positioning System (GPS) device as illustrated, a cell tower triangulation device, and/or a variety of other location determination devices known in the art.) In one implementation, the disk drive component 510 may comprise a database having one or more disk drive components.

In accordance with embodiments of the present disclosure, the computer system 500 performs specific operations by the processor 504 executing one or more sequences of instructions contained in the memory component 506, such as described herein with respect to the container system 102 and 200, the user device 104, and/or the network service platform 108. Such instructions may be read into the system memory component 506 from another computer readable medium, such as the static storage component 508 or the disk drive component 510. In other embodiments, hard-wired circuitry may be used in place of or in combination with software instructions to implement the present disclosure.

Logic may be encoded in a computer readable medium, which may refer to any medium that participates in providing instructions to the processor 504 for execution. Such a medium may take many forms, including but not limited to, non-volatile media, volatile media, and transmission media. In one embodiment, the computer readable medium is non-transitory. In various implementations, non-volatile media includes optical or magnetic disks, such as the disk drive component 510, volatile media includes dynamic memory, such as the system memory component 506, and transmission media includes coaxial cables, copper wire, and fiber optics, including wires that comprise the bus 502. In one example, transmission media may take the form of acoustic or light waves, such as those generated during radio wave and infrared data communications.

Some common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, carrier wave, or any other medium from which a computer is adapted to read. In one embodiment, the computer readable media is non-transitory.

In various embodiments of the present disclosure, execution of instruction sequences to practice the present disclosure may be performed by the computer system 500. In various other embodiments of the present disclosure, a plurality of the computer systems 500 coupled by a communication link 524 to the network 106 (e.g., such as a LAN, WLAN, PTSN, and/or various other wired or wireless networks, including telecommunications, mobile, and cellular phone networks) may perform instruction sequences to practice the present disclosure in coordination with one another.

The computer system 500 may transmit and receive messages, data, information and instructions, including one or more programs (i.e., application code) through the communication link 524 and the network interface component 512. The network interface component 512 may include an antenna, either separate or integrated, to enable transmission and reception via the communication link 524. Received program code may be executed by processor 504 as received and/or stored in disk drive component 510 or some other non-volatile storage component for execution.

The present disclosure may be implemented using hardware, software, or combinations of hardware and software. Also, where applicable, the various hardware components and/or software components set forth herein may be combined into composite components comprising software, hardware, and/or both without departing from the scope of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed:

1. A container module, comprising:

a container module chassis configured to be housed in a first handle portion of a first bottle container that includes a first bottle container chassis;

a first type communication interface housed by the container module chassis;

a second type communication interface housed by the container module chassis;

a first processing system that is housed by the container module chassis and that is coupled to the first type communication interface and the second type communication interface; and a first memory system that is housed by the container module chassis and that includes instruction that, when executed by the first processing system, causes the first processing system to provide a container engine that is configured to:

receive, via the first type communication interface from a corresponding first type communication interface in a first closure chassis, a first notification that the first closure chassis has experienced a tamper event, wherein the first closure chassis is configured, when coupled to a container chassis, to prevent movement of a material between a container volume defined by the container chassis and an exterior of the container chassis via an aperture; and provide, via the second type communication interface and via a wide area network, the first notification to a network service platform.

2. The container module of claim 1, wherein the container engine is configured to:

determine that the wide area network is unavailable; and store the first notification in a local database until the wide area network is again available.

3. The container module of claim 1, wherein the first closure chassis is coupled to the first bottle container chassis to prevent movement of a material between a bottle container volume defined by the first bottle container chassis and an exterior of the first bottle container chassis via a bottle aperture defined by the first bottle container chassis.

4. The container module of claim 1, wherein the first closure chassis is coupled to the container chassis that is different than the first bottle container chassis.

5. The container module of claim 1, wherein the first notification includes at least one of a closure identifier associated with the first closure chassis or a seal identifier associated with a seal that is configured to join the container chassis and the first closure chassis.

6. The container module of claim 5, wherein the first notification also includes at least one of a container identifier, a time associated with the tamper event, container sensor data, material information associated with the material, or location information associated with a location at which the tamper event was detected.

7. The container module of claim 1, wherein the container engine is configured to:

receive, via the first type communication interface from a corresponding first type communication interface in a second closure chassis, a second notification that the second closure chassis has experienced a second tamper event; and provide, via the second type communication interface and via the wide area network, the second notification to the network service platform.

8. A method, comprising:

receiving, via a first type communication interface included on a container module housed in a handle portion of a bottle container that includes a bottle container chassis from a corresponding first type communication interface in a first closure chassis, a first notification that the first closure chassis has experienced a tamper event, wherein the first closure chassis is configured, when coupled to a container chassis, to prevent movement of a material between a container volume defined by the container chassis and an exterior of the container chassis via a first aperture; and providing, via a second type communication interface included in the container module and via a wide area network, the first notification to a network service platform.

9. The method of claim 8, further comprising determining, by the container module, that the wide area network is unavailable; and storing, by the container module, the first notification in a local database until the wide area network is again available.

10. The method of claim 8, wherein the first closure chassis is coupled to the bottle container chassis to prevent movement of a material between a bottle container volume defined by the bottle container chassis and an exterior of the bottle container chassis via a bottle aperture defined by the bottle container chassis.

11. The method of claim 8, wherein the first closure chassis is coupled to a container chassis that is different than the bottle container chassis.

12. The method of claim 8, wherein the first notification includes at least one of a closure identifier associated with the first closure chassis or a seal identifier associated with a seal that is configured to join the container chassis and the first closure chassis.

13. The method of claim 12, wherein the first notification includes at least one of a container identifier, a time associated with the tamper event, container sensor data, material information associated with the material, or location information associated with a location at which the tamper event was detected.

14. The method of claim 8, further comprising:

receiving, by the container module via the first type communication interface from a corresponding first type communication interface in a second closure chassis, a second notification that the second closure chassis has experienced a second tamper event; and providing, by the container module via the second type communication interface and via the wide area network, the second notification to the network service platform.

15. A bottle container system, comprising:

a bottle container chassis defining:

a handle portion, a bottle container volume, and a first bottle aperture;

a bottle closure chassis that is coupled to the bottle container chassis to prevent movement of a material between the bottle container volume and an exterior of the bottle container chassis via the first bottle aperture and that includes:

a first type first communication interface housed by the bottle closure chassis, a first processing system that is housed by the bottle closure chassis and that is coupled to the first type first communication interface; and a first memory system that is housed by the bottle closure chassis and that includes instruction that, when executed by the first processing system, causes the first processing system to provide a security engine; and a container module chassis that is housed in the handle portion and that includes:

a first type second communication interface housed by the container module chassis;

a second type second communication interface housed by the container module chassis;

a second processing system that is housed by the container module chassis and that is coupled to the first type second communication interface and the second type second communication interface; and a second memory system that is housed by the container module chassis and that includes instruction that, when executed by the first processing system, causes the first processing system to provide a container engine that is configured to:

receive, via the first type second communication interface from the first type first communication interface, a first notification that the bottle closure chassis has experienced a first tamper event; and provide, using the second type first second communication interface and via a wide area network, the first notification to a network service platform.

16. The bottle container system of claim 15, wherein the container engine is configured to:

determine that the wide area network is unavailable; and store the first notification in a local database until the wide area network is again available.

17. The bottle container system of claim 15, wherein the first notification includes at least one of a closure identifier associated with the bottle closure chassis or a seal identifier associated with a seal that is configured to join the bottle container chassis and the bottle closure chassis.

18. The bottle container system of claim 17, wherein the first notification includes at least one of a container identifier, a time associated with the first tamper event, container sensor data, material information associated with the material, or location information associated with a location at which the first tamper event was detected.

19. The bottle container system of claim 15, wherein the container engine is configured to:

receive, via the first type second communication interface from a corresponding first type third communication interface in a second closure chassis, a second notification that the second closure chassis has experienced a second tamper event; and provide, using the second type first second communication interface and via the wide area network, the second notification to the network service platform.

20. The bottle container system of claim 15, further comprising:

a seal that is configured to couple the bottle closure chassis to the bottle container chassis;

a first sensor subsystem that is housed by the bottle closure chassis and that is configured to:

wirelessly detect a lack of presence of the seal due to the seal being at least one of being removed from the bottle closure chassis, damaged, or replaced; and generate, in response to the lack of presence, a first sensor signal indicating the first tamper event, wherein the security engine is configured to:

receive the first sensor signal indicating that the seal has experienced the first tamper event; and provide, in response to receiving the first sensor signal using the first type communication first interface, the first notification to the first type second communication interface that the seal has experienced the first tamper event.

* * * * *